US006063558A

United States Patent [19]

Loccufier et al.

[11] Patent Number: 6,063,558

[45] Date of Patent: May 16, 2000

[54] PHOTOSENSITIVE ELEMENT CONTAINING A SILVER HALIDE EMULSION CHEMICALLY SENSITIZED WITH A CHALCOGENIC COMPOUND

[75] Inventors: Johan Loccufier, Zwijnaarde; René De Keyzer, Waasmunster; Antonius Rutges, Boechout, all of Belgium

[73] Assignee: Agfa-Gevaert, N.V., Mortsel, Belgium

[21] Appl. No.: 09/317,626

[22] Filed: May 25, 1999

Related U.S. Application Data

[63] Continuation-in-part of application No. 09/115,627, Jul. 14, 1998, abandoned.

[30] Foreign Application Priority Data

Aug. 1, 1997 [EP] European Pat. Off. ..... 97202395

[51] Int. Cl.[7] ..... G03C 1/09

[52] U.S. Cl. ..... 430/600; 430/603; 430/611; 430/614

[58] Field of Search ..... 430/603, 606, 430/611, 614

[56] References Cited

FOREIGN PATENT DOCUMENTS 19635098 3/1998 Germany .

*Primary Examiner*—Janet Baxter
*Assistant Examiner*—Amanda C. Walke
*Attorney, Agent, or Firm*—Breiner & Breiner

[57] ABSTRACT

A photosensitive element which comprises on a support at least one photosensitive silver halide emulsion layer and at least a non-light sensitive layer, wherein the silver halide emulsion layer comprises a chalcogenic compound satisfying formula (1):

(1)

wherein:

X represents Se or Te, forming a double bond with its neighbouring C-atom,

Nu represents a nucleophilic group which brings an electron pair in heterolytic bond formation; Nu has a $pK_a$-value of at least 2.0 if Nu is an acidic group, L represents a divalent linking group representing each group which can position an electron donating atom in any of the 5th to the 8th position vis-a-vis the carbon atom of the carbon-chalcogen double bond, AQB represents the necessary atoms to form a heterocyclic 5- or 6-membered ring, provided that when A is a Nitrogen-atom, B is an atom selected from the group consisting of $NR^1$, O, S, Se and Te, $R^1$ can represent a hydrogen, an alkyl group, an acyl-group, an aryl group, an aralkyl group or a heteroaryl group;

and a method wherein said chalcogenic compound is used during the step of chemically sensitizing at least one of the said silver halide emulsions at a pH-value situated between 3 and 10, a pAg-value situated between 6 and 11 and a temperature in the range of from 40° C. up to 95° C.

14 Claims, No Drawings

PHOTOSENSITIVE ELEMENT CONTAINING A SILVER HALIDE EMULSION CHEMICALLY SENSITIZED WITH A CHALCOGENIC COMPOUND

This is a continuation in part application of Ser. No. 09/115,627, filed Jul. 14, 1998, abandoned.

FIELD OF THE INVENTION

The present invention relates to a photosensitive image-forming element, more particularly to a high sensitive photographic silver halide emulsion with improved photographic properties.

BACKGROUND OF THE INVENTION

In the industrial world a continuous need exists for photosensitive image-forming materials with increased sensitivity and image-quality. These characteristics are related which means that influencing one parameter has its consequences for the other parameter and vice versa. This relationship can clearly be experienced in silver halide photographic materials. An increase of sensitivity of a photographic silver halide material can for instance be realised by an increase of the mean size of the silver halide grains contained in the emulsion of the said material which in turn often results in a decrease of sharpness or contrast of the said material. This particular problem can for instance be solved by increasing the efficiency for electron trapping of the latent-image of a silver halide grain which can be realised by chemical sensitization in the presence of a compound which increases the electron-trapping efficiency mentioned hereinbefore. This compound can be for instance a sulphur compound, a gold salt or a combination of both. It has been noticed in recent years that chemical sensitization with a chalcogenic compound other than sulphur is increasingly practicized in order to enhance photographic sensitivity. These compounds in turn often give rise to an increasing tendency of fog formation and often to stability problems.

Looking at these problems which are for instance related to selenium sensitization various suggestions have already been formulated in the patent literature. Examples of selenium compounds which were suggested for use in order to get an increased sensitivity were substituted selenourea (as described e.g. in EP-A 0 280 031, EP-A 0 458 278), selenoethers (e.g. in JP-A 2-132434, JP-A 4-271341, JP-A 6-175258, U.S. Pat. No. 5,532,120), diselenides (e.g. in EP-A 0 703 492), selenoesters (e.g. in U.S. Pat. No. 5,306, 613), selenoketones (e.g. in EP-A 0 476 345), phosphineselenides (e.g. in EP-A 0 506 009) and various others. However as mentioned hereinbefore selenium sensitization easily causes fog as a result of the depth of the electron trap of the formed sensitivity speck which is larger than the depth of the sensitivity speck created by sulphur sensitization. At the same time the stability and the gradation of a selenium sensitized emulsion decrease if no precautions are taken. An alternative way is described by G. J. Burgmaier et al in U.S. Pat. No. 4,810,626 which provides a silver halide photographic material comprising a sensitizing amount of a tetrasubstituted urea compound with the following general structure: $N(A_1R_1)(A_2R_2)-C(=X)-N(A_3R_3)(A_4R_4)$ where X equals S, Se or Te and where S is preferred (due to the greater solubility of the thiourea compound in aqueous solutions where silver halide sensitization occurs and also to the ready availability of starting materials for thiourea synthesis). In this formula at least one of $A_1R_1$ to $A_4R_4$ contains a nucleophilic group bonded to the urea nitrogen atom through a 2 or 3 member chain while each of $R_1$, $R_2$, $R_3$ and $R_4$ independently represents an alkylene, cycloalkylene, carbocyclic arylene, heterocyclic arylene, alkarylene or aralkylene group and each of $A_1$, $A_2$, $A_3$ and $A_4$ independently is hydrogen or represents a carbocyclic, sulfinic, sulfonic, hydroxamic, mercapto, sulfonamido or a primary or secondary amino nucleophilic group. The chalcogenic atom in the urea compounds of the Burgmaier patent is activated by the nucleophilic group which is generally called a neighbouring group. This type of reactions is summarized by the term 'neighbouring group participation', describing all the intramolecular reactions and all the reactions which involve non-electrostatic through-space interactions between groups within the same molecule. Another example is in principle also described in EP-A 0 458 278. Further DE 196.35.096 and DE 196.48.008 describe the use of chemical selenium sensitization combined with a spectral sensitization with a well-defined sensitizer structure. The group of chemical selenium sensitizers used in these applications shows different chemical structures as already mentioned hereinbefore and does not show the sensitivity-fog relationship which is needed for the new photographic materials of tomorrow. In U.S. Pat. No. 4,810,626, EP-A 0 458 278 and in both DE-applications as well, substantial increase of sensitivity can be realized with the chemical sensitizers mentioned but like in the other patent proposals described hereinbefore no clear demonstration is given that fog could be kept under control. Accordingly there still exists a strong demand for chemical chalcogenic sensitizers which give a deeper electron trap than the corresponding S-sensitizers but in combination with an acceptable low fog level.

OBJECTS OF THE INVENTION

It is therefore a first object of the invention to provide a photosensitive element with high photosensitivity combined with low fog level.

It is also an object of this invention to provide a class of chalcogenic compounds which are functionalised with a neighbouring group facilitating the kinetics of chemically sensitizing a silver halide emulsion.

It is another object of the invention to provide a photosensitive element comprising at least one silver halide emulsion which is chemically sensitized in the presence of said new class of chalcogenic sensitizers.

It is a further object of the invention to provide a method for making a photosensitive element comprising on a support a silver halide emulsion which is chemically sensitized in the presence of a said new class of chalcogenic compounds.

Further objects and advantages of the invention will become apparent from the description hereinafter.

SUMMARY OF THE INVENTION

The objects just mentioned are realized by a photosensitive element which comprises on a support at least one photosensitive silver halide emulsion layer and at least one non-light sensitive layer wherein the silver halide emulsion layer comprises a chalcogenic compound satisfying formula (1):

(1)

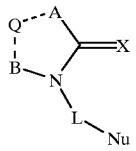

wherein:

X represents Se or Te, forming a double bond with its neighbouring C-atom,

Nu represents a nucleophilic group which brings a free electron pair in heterolytic bond formation; Nu has a $pK_a$-value of at least 2.0 if Nu is an acidic group, L represents a divalent linking group representing each group which can position an electron donating atom in any of the 5th to the 8th position vis-a-vis the carbon atom of the carbon-chalcogen double bond, AQB represents the necessary atoms to form a heterocyclic 5- or 6-membered ring, provided that when A is a Nitrogen-atom, B is an atom selected from the group consisting of $NR^1$, O, S, Se and Te, $R^1$ can represent a hydrogen atom, an alkyl group, an acyl group, an aralkyl group or a heteroaryl group;

or preferably a chalcogenic compound satisfying formula (2):

(2)

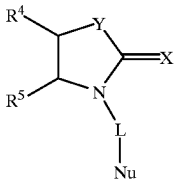

wherein:

each of X, Nu and L has the same significance as defined in formula (1),

Y represents S, O, $CR^2R^3$, Se or Te, $R^2$ and $R^3$ each independently represents a hydrogen atom, an alkyl group, an aryl group, an aralkyl group or a heteroaryl group, or $R^2$ and $R^3$ each independently represents the atoms which together with $R^4$ or $R^5$ are necessary to form a ring structure, or $R^2$ and $R^3$ each independently represents a hydrogen atom, an alkyl group, an aryl group, an aralkyl group or a heteroaryl group which combine to form a ring structure, $R^4$ and $R^5$ each independently represents a hydrogen atom, an alkyl group, an aryl group, an aralkyl group or a heteroaryl group, or $R^4$ and $R^5$ together represent the atoms necessary to form a ring structure;

or most prefered a chalcogenic compound represented by formula (3):

(3)

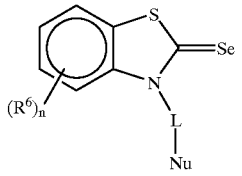

wherein:

each of Nu and L has the same significance as defined for formula (1), $R^6$ represents a hydrogen atom, an alkyl group, an aryl group, an aralkyl group or a heteroaryl group, or one or more $R^6$-substituents together represent the atoms necessary to form a ring structure, n equals 0, 1, 2, 3 or 4.

The invention also provides a method for chemically sensitizing a silver halide emulsion by means of a chalcogenic compound represented by formulae (1), (2) or (3) at least partly in the presence of a silver halide solvent and a spectral sensitizer at a pH-value situated between 3 and 10, a pAg-value situated between 6 and 11 and a temperature in the range of from 40° C. up to 95° C.

Preferred embodiments of the invention are disclosed in the dependent claims hereinafter.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

The present invention as described in the foregoing summary will now be explained in detail starting with an illustration of the compounds satisfying formulae (1),(2) and (3) of the present invention.

Heterocyclic selenones are known for quite a long time in organic synthesis as usefull synthetic intermediates for functional group transformation such as the conversion of epoxides to double bonds (Calo et al, Synthesis, (1976) 200–201). Potentially they can be used for chemical sensitization of silver halide photographic emulsions in which treatment the photosensitivity is incrased. However, the reactivity of the basic products is too low to be useful under conventional circumstances, used for chemical sensitization, as illustrated by the use of 3-methyl-2-selenoxobenzothiazole (Ref-1) as chemical sensitizer.

Ref-1

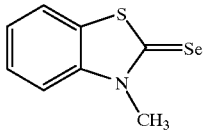

We found that the introduction of a nucleophilic group at a well defined position in the structure of heterocyclic selenones, rendered them usefull as chemical sensitizer for photographic applications.

The introduction of anchimeric assistance or neighboring group participation into the structure, is capable of lowering the pH or the free silver ion concentration needed for chemical sensitization, allowing this sensitivity step under conditions where the tendency of fog formation can be controlled. A general discussion on neighboring group participation is given in Advanced Organic Chemistry, J. March, 4th edition, John Wiley and Sons, p. 308–326 and in Neighboring Group Participation Volume I, B. Capon and S. P. McManus, Plenum Press (1976).

We found that compounds of the following general formula (1) are particularly useful in the present invention.

(1)

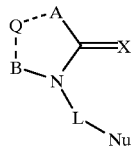

In this formula (1) Nu is a nucleophilic group which is defined as a group containing at least one atom having at least one free electron pair which can be brought in heterolytic bond formation. The nucleophilic group can be anionic or neutral, and is preferably selected from the group consisting of carboxylates, alcohols, ethers, thiols, thioethers and amines. Out of the group of all possible amines only the unprotonated forms can be used in the present application while the quaternary N-groups are lacking a free pair of electrons. If the nucleophilic group is an acidic group the acidity is an important factor in the chemical sensitization activity as meant in this invention. Nucleophilic groups which has a high acidity do not have enough reactivity. If the pKa-value is used to express the acidity all nucleophilic groups having a pKa-value of 2.0 or more can be used in the present invention. Nucleophilic groups like alkyl-, aryl- or aralkyl-sulphonic acids (or its salts) which are attached to the N-atom neighbouring the 'C=X'-group and which have a pKa-value less than 1.0 do not have the chemical sensitization effect as claimed in the present invention. An example of these compounds can be found in DE 196.35.098 (see compound Se-11) and DE 196.48.008 (see compound Se-6) which cannot be used in the context of the present invention. But compounds of formula (1) with other nucleophilic acid groups like for instance alkyl-, aryl- or aralkyl-carbonic acids which have a pKa-value in the range of 4.0–5.0 are preferably used.

L is a divalent linking group, positioning the free electron air-containing atom of the nucleophilic group in the 5th- to 8th-position vis-a-vis the carbon atom of the carbon-chalcogen double bond; examples of such divalent linking groups which can be used in the present invention are alkylene, alkenylene and heterocyclic and carbocyclic arylene groups. Prefered divalent linking groups used in the present invention are methylene, ethylene or propylene groups.

AQB represents the necessary atoms to form a substituted or non-substituted heterocyclic 5- or 6-membered ring, provided that when A is a Nitrogen-atom, B is an atom selected from the group consisting of NR1, O, S, Se and Te. Many chemical structures which are covered by this description can be used in the present invention. Heterocyclic rings which are typically useful are thiazoles, benzothiazoles, benzimidazoles, imidazoles, triazoles, pyridines and pyrimidines, but the present invention is not limited to these types of heterocycles. Some derivatives of these chemical compounds are given hereinafter as examples. R1 in the given description can represent a hydrogen atom, an alkyl group, an acyl group, an aryl group, an aralkyl group or a heteroaryl-group.

Chalcogenic compounds which are preferred for use in this invention are described by formula (2):

(2)

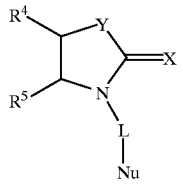

wherein:

each of X, Nu and L has the same significance as defined in formula (1),

Y represents S, O, $CR^2R^3$, Se or Te; examples of chemical compounds according to this condition are given in a general list of examples hereinafter which is not limitive;

$R^2$ and $R^3$ each independently represents a hydrogen atom, an alkyl group, an aryl group, an aralkyl group or a heteroaryl group, or $R^2$ and $R^3$ each independently represents the atoms which together with $R^4$ or $R^5$ are necessary to form a ring structure, or $R^2$ and $R^3$ each independently represents a hydrogen atom, an alkyl group, an aryl group, an aralkyl group or a heteroaryl group which combine to form a ring structure, $R^4$ and $R^5$ each independently represents a hydrogen atom, an alkyl group, an aryl group, an aralkyl group or a heteroaryl group, or $R^4$ and $R^5$ together represent the atoms necessary to form a ring structure.

The most preferred chalcogenic compound which can be used in this invention is represented by formula (3):

(3)

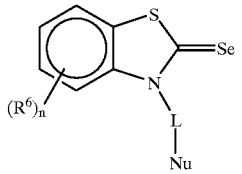

wherein:

Nu and L has the same significance as described in formulae (1) and (2), $R^6$ represents a hydrogen atom, an alkyl group, an aryl group, an aralkyl group or a heteroaryl group, or one or more $R^6$-substituents together represent the atoms necessary to form a ring structure, n equals 0, 1, 2, 3 or 4.

Typical, but not limiting examples of compounds useful in the present invention are given below.

S-I
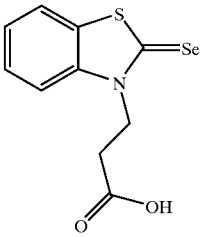
S-II
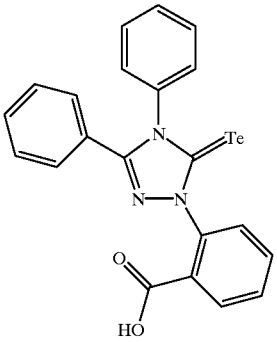
S-III
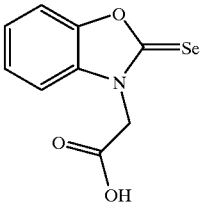
S-IV
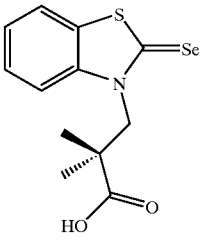
S-V
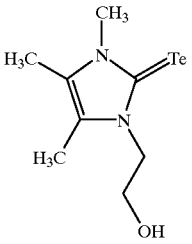
-continued
S-VI
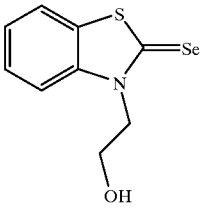
S-VII
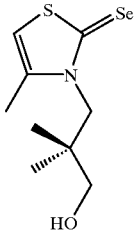
S-VIII
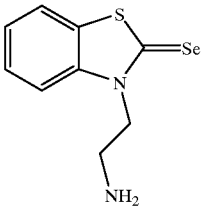
S-IX
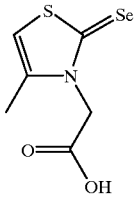
S-X
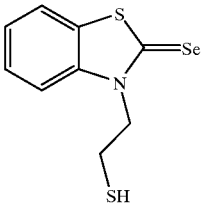
S-XI
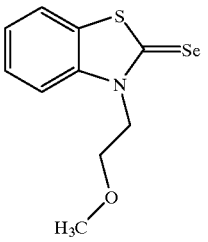

-continued

S-XII

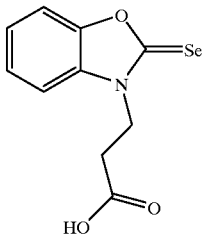

S-XIII

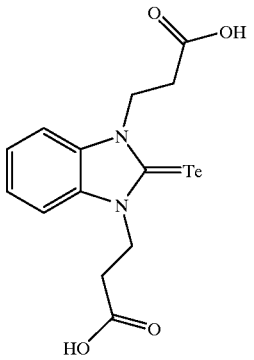

S-XIV

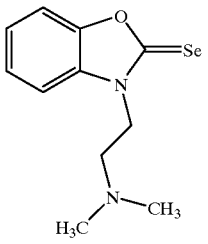

S-XV

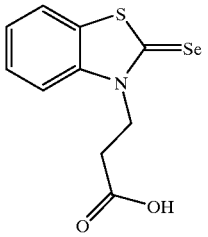

S-XVI

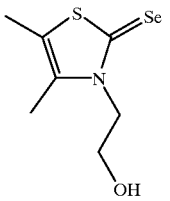

-continued

S-XVII

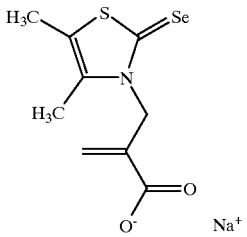

S-XVIII

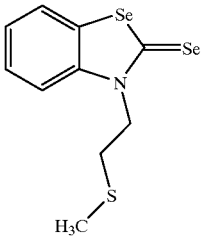

The $pK_a$-values which are critical for the activity of the selenium compounds with an acidic nucleophilic group as represented by formula (1), are summarized in the following Table. The $pK_a$-value of a substituted or unsubstituted amine as nucleophilic group Nu is always directed to the dissociation of the unprotonated amine.

| Number of Se-Compound | $pK_a$-value | Number of Se-Compound | $pK_a$-value |
|---|---|---|---|
| S-I | 4.8–4.9 | S-X | >7 |
| S-II | 4.2 | S-XI | n.rel*) |
| S-III | 4.6–4.7 | S-XII | 4.8–4.9 |
| S-IV | 4.8–4.9 | S-XIII | 4.8 |
| S-V | >15 | S-XIV | n.rel*) |
| S-VI | >15 | S-XV | 4.8 |
| S-VII | >15 | S-XVI | >15 |
| S-VIII | >>15 | S-XVII | 4.2–4.3 |
| S-IX | 4.6–4.7 | S-XVIII | n.rel*) |

*) n.rel. = not relevant for this compound.

The compounds used in the present invention can be prepared by conventional synthetic strategies. As an illustration, the synthesis of sensitizer I and VI will be described.

The synthesis of sensitizer I

General scheme:

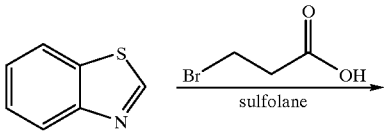

-continued

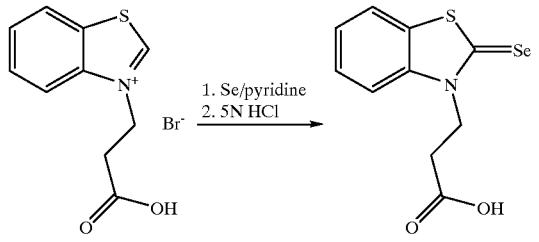

(a) The alkylation of benzothiazole.

A mixture of 54 g (0.4 mol) benzothiazole, 61.2 g (0.4 mol) 2-bromopropionic acid and 40 ml sulfolane was heated to 130° C. After 90 minutes, the alkylated intermediate started to precipitate. On further alkylation the mixture solidified. The mixture was allowed to cool down and 100 ml acetone was added. The precipitated product was isolated by filtration, treated with 200 ml acetone, isolated by filtration for a second time, washed with 50 ml acetone and dried under reduced pressure (96 5g, 83%)

(b) The synthesis of the selenone.

14.4 g (0.05 mol) of the quaternary salt was dissolved in 100 ml pyridine. 3.95 g (0.05 mol) selenium was added. The mixture was refluxed for 6 hours and then allowed to cool down. After filtration to remove residual selenium, the mixture was pourred into 600 ml of a 5 N solution of hydrochloric acid. After precipitation the product was isolated by filtration. The product was finally purified by preparative column chromatography (eluent $CH_2Cl_2$/MeOH 95/5). (7.5 g, 52.5%)

The synthesis of sensitizer VI:

General scheme:

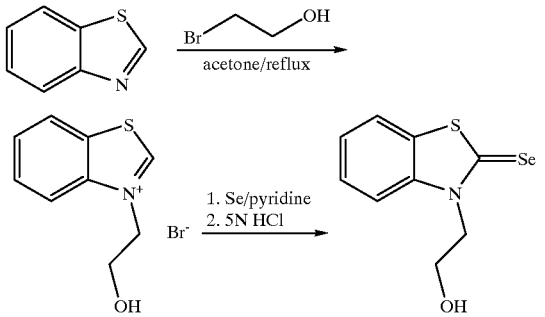

(a) The alkylation of benzothiazole.

A mixture of 67.5 g (0.5 mol) benzothiazole and 62.5 g (0.5 mol) bromoethanol in 100 ml acetone was refluxed for four hours. The mixture was allowed to cool down. The product precipitated on diluting with methylenechloride. The product was isolated by filtration, washed with ether and dried under reduced pressure (25 g, 19%).

(b) The synthesis of the selenone.

13 g (0.05 mol) of the quaternary salt was dissolved in 75 ml pyridine. 3.95 g (0.05 mol) selenium was added and the mixture was refluxed for four hours. The residual selenium was removed by filtration and 225 ml water was added to the mixture. The product crystallized from the medium with some difficulty. The crude product was isolated by fitration and recrystallized from ethanol (8 g, 62%).

The amount of the chalcogenic compound of formulae (1), (2) or (3) which can be used in the material of the present invention can vary depending on the type of compound, the type of silver halide grain, the conditions of chemical sensitization, etc. The amount of the said chalcogenic sensitizer is usually in the range of $10^{-9}$ to $10^{-3}$ but preferably in the range of $10^{-8}$ to $10^{-4}$ and more preferrably in the range of $10^{-7}$ to $10^{-5}$ mole per mole silver halide.

The introduction of the chemical chalcogenic sensitizer represented by formulae (1), (2) or (3) can be done in various ways before starting or during the chemical sensitization procedure. Said chalcogenic sensitizers which are more or less water soluble can be added to the dispersion of silver halide crystals as an aqueous solution if desired mixed up with a water soluble organic solvent. Said sensitizers which are not water soluble can be introduced after solving the compound in a water soluble organic solvent which is normally used for the introduction of water unsoluble products in a photographic silver halide emulsion. An alternative way for the introduction of an unsoluble chemical chalcogenic sensitizer is using an 'oil-in-water' dispersion or if desired a dispersion as disclosed in EP-A 0 703 492 by T. Yoshida et al. In the last named patent the said compound is therefore added to the silver halide emulsion before chemical sensitization in the form of a solid partical dispersion soluble in water.

Combinations of the chalcogenic compounds of the present invention can be used but can also be combined with other chalcogenic or other more "classical" sensitizers. The chemical sensitization itself can be carried out in the presence of a sulphur compound, a chalcogenic compound and if desired in the presence of a noble metal (e.g. gold). The sensitization in the presence of the chalcogenic compound represented by formulae (1), (2) or (3) and if desired together with any other chemical sensitizer, can be used in combination with a reduction sensitization too.

In the noble metal sensitization a salt of a noble metal (e.g., gold, iridium, palladium, platinum) is used but gold salts are preferably used as noble metal sensitizer. Examples of gold sensitizers which are often used include chloroauric acid, goldsulfide, chloroaurate salts, aurithiocyanate and goldselenide. The amount of the noble metal sensitizer can vary between $10^{-7}$ and $10^{-2}$ mole per mole silver halide.

Sulfur sensitization can be carried out with sulphur compounds like thiosulphates, thioureas, rhodamines, etc. The sulphur sensitizer can also be used in an amount of about $10^{-7}$ to $10^{-2}$ mole per mole silver halide.

In reduction sensitization a reducing compound is used like thiourea dioxide, hydrazine derivatives, sulphinic acid, polyamine compounds, stannous chloride, borane compounds, reductones like ascorbic acid, etc. Reduction sensitization can also be carried out at a low pAg or at a high pH or at both and if desired at elevated temperature. This kind of sensitization is refered to 'silver ripening'. More information can be found in Research Disclosure, Vol307, 307105 and in P. Glafkides "Chimie et Physique Photographic", P. Montel—Paris, $5^{th}$ Ed., 1987.

The chemical sensitization with compounds of the present invention satisfying formulae (1), (2) or (3) should be carried out in the presence of a silver solvent which preferably should be thiocyanate. This should be added as a sodium, a potassium or an ammonium salt but it is not limited thereto. The thiocyanate salt can be added before or during the addition of said compound of the invention and before, during or after the addition of any other chemical sensitizer which can be or should be used together with the said selenium sensitizer. The amount of the thiocyanate which should be present together with said chemical sensitizer represented by formulae (1), (2) or (3) is limited between $10^{-6}$ and $10^{-1}$ mole per mole silver halide and preferably situated between $10^{-5}$ and $10^{-2}$ mole per mole silver halide.

The chemical sensitization has also to be carried out in the presence of a spectral sensitizer. This can be a dye out of different chemical classes including polymethine dyes comprising cyanines, merocyanines, tri-, tetra- and polynuclear cyanines and merocyanines, oxanols, hemioxanols, styryls, merostyryls and so on. Many representitive examples of these dye-classes can be found in EP-A 0 618 492, EP-A 0 638 841, U.S. Pat. No. 5,308,748, U.S. Pat. No. 5,310,645 and U.S. Pat. No. 5,338,656. Some types of spectral sensitizers are preferably used for this invention. It concerns the symmetrical or the unsymmetrical cyanine dyes containing a benzoxazole, benzthiazole or benzimidazole nucleus.

Sometimes more than one spectral sensitizer may be used in the case that a larger part of the spectrum has to be covered. Combinations of several spectral sensitizers are sometimes used to get supersensitization, which means that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, and so on. Many of the the possibilities in spectral sensitization which can be important with respect to this invention are described in Res.Discl., 38957 (1996) section V.

The chemical sensitization described in the present invention should be carried out within limited chemical and physical conditions. Therefore the pAg should be in the range of 6 till 11 but preferably between 7 and 10. Further the pH should be in the range of 3 to 10, preferably 4 to 8.5 while the temperature should be situated in the range between 40 to 95 degrees C, preferably between 45 to 85 degrees C, though there is no particular limitation to any of these conditions.

The silver halide emulsion can be prepared in various ways by conventional methods. These start always with a nucleation phase followed by a grain growth phase. In this last phase of the emulsion preparation reactants can be added to the reaction vessel in the form of solutions of silver and halide salts or in the form of preformed silverhalide nuclei or fine grains which easily dissolve in the precipitation medium.

The individual reactants can be added through surface or subsurface delivery tubes by hydrostatic pressure or by an automatic delivery system for maintaining the control of pH and/or pAg in the reaction vessel and of the rate of the reactant solutions introduced in it. The reactant solutions or dispersions can be added at a constant rate or a constantly increasing, decreasing or fluctuating rate, if desired in combination with stepwise delivery procedures. More details about the possible ways in making a silver halide emulsion which can be principally used in practizising this invention are summarized in Res.Discl., 38957 (1996)591–639 section I-C.

Beside the individual reactants neccesary to form silver halide crystals additional chemical metal salts can be added for occlusion in the crystal lattice. Such compound is replacing an appropiate of silver and halide ions in the silver halide lattice. These so-called dopants can be distinguished from the metal complexes which are added just before coatingas an additive by EPR- or ENDOR-technique. These dopants can be used to modify the crystal structure or the crystal properties and can therefore be employed to influence many photographical properties like sensitivity, reciprocity failure, gradation, pressure sensitivity, fog, stability, etc. When coordination complexes or even oligomeric coordination complexes are used the different ligands bound at the central metal ion can be occluded in the crystal lattice too and in this way influence the photographic properties of the silver halide materials as well. Dopants which are introduced in emulsions of the present invention are those which can act as a permanent or as a non-permanent electron trap.

The doping procedure itself can normally be executed at any stage during the grain growth phase of the emulsion preparation. It is important to know that the dopants can also be added in an indirect way by the addition of a dispersion containing very fine soluble silver halide grains or nuclei comprising the dopant. More additional information about the introduction and the use of dopants in the emulsion crystals of this invention can be found in Research Disclosure, 38957 (September 1996), section I-D.

The photographic emulsions prepared in this way contain silver halide crystals comprising chloride, bromide or iodide alone or in combinations thereof. Other silver salts which can be incorporated in a limited amount in the silver halide lattice are silver phosphate, silver thiocyanate, silver citrate and some other silver salts. The chloride and bromide halide can be combined in all ratios to form a silverchlorobromide salt. Iodide ions however can be coprecipitated with chloride and/or bromide ions in forming a iodohalide with an iodide amount which depends on the saturation limit of iodide in the lattice with the given halide composition; this means up to a maximum amount of about 40 mole percent in silver iodobromide and up to at most 13 mole procent in silver iodochloride both based on silver.

The composition of the halide can change in the crystal in a continous or discontinous way. Emulsions containing crystals composed of various sections with different halide compositions are used for several photographic applications. So a structure with a difference in halide composition between the center and the rest of the crystal (what is called 'core-shell'-emulsion) or with more than two crystal parts differing in halide composition (called a 'band'-emulsion) may occur. The changes in halide composition can be realised by direct precipitation or in an indirect way by conversion where fine silver halide grains of a certain halide composition are dissolved in the presence of the so-called host grains forming a 'shell' or 'band' on the given grain.

The crystals formed by the methods described above have a morphology which can be tabular or non-tabular. In tabular crystals the aspect ratio (ratio of equivalent circular diameter to thickness) can vary from low (<2) over 'medium' (2 till 8) to high (>8) where specially in the case of the ultra thin tabular crystals high aspect ratios can be realised. The major faces of the formed tabular grains can have a {111} or a {100}-habitus the structure of which is (respectively) stable or has to be stabilised (for instance by a 'habitus modifying agent'). In the class of non-tabular grains there are a lot of possibilities which can be divided in the more regular shaped crystals or the crystals with a mixed crystal habit.

For certain applications it can be important to apply a well-defined amount of iodide on the crystal surface under controlled conditions in order to get reproducible sensitometric results after image-wise exposure and subsequent processing. This can be done by using an iodide releasing agent as described in EP-A 0 561 415 and in EP-A 0 563 708 and applied on emulsions before, during or after the chemically sensitization in addition to the method and the conditions of the present invention as described hereinbefore.

The photographic emulsions of the present invention can be comprised of silver chloride, silver bromide and silver iodide, silver chlorobromide, silver chloroiodide, silver bromoiodide, silver chlorobromoiodide or mixtures thereof.

A hydrophilic colloid is used as a binder or a protective colloid for the emulsion or any other layer of the photographic material of the invention. Gelatin is an advantageous hydrophilic colloid. The preparation of conventional lime-treated or acid-treated gelatin has been descibed in e.g. "The Science and Technology of Gelatin", edited by A. G. Ward and A. Courts, Academic Press 1977, page 295 and further. The gelatin can also be enzyme-treated as described in Bull.Soc.Sci.Phot.Japan, Nr 16, page 30 (1966).

Gelatin may, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents, by grafting of polymerisable monomers on gelatin or prehardened gelatins with blocked functional groups as a consequence of this prehardening treatment, cellulose derivatives such as hydroxyalkyl cellulose, carboxymethyl cellulose, phthaloyl cellulose, and cellulose sulphates and even potato starch.

Further synthetic high molecular compounds described in JP-B-52-16365, Journal of The Society of Photographic Science and Technology of Japan, Vol. 29 (1), 17, 22 (1966), ibid., Vol. 30 (1), 10, 19 (1967), ibid., Vol. 30 (2), 17 (1967), and ibid., Vol. 33 (3), 24 (1967) may be used as a dispersion medium. Also the crystal habit restraining agent described in EP-A 0 534 395 may be used.

Part of gelatin may further be replaced with a synthetic or natural high-molecular material.

An interesting substitute for gelatin may be silica as has been described in the published EP-A's 0 392 092, 0 517 961, 0 528 476 and 0 649 051 and 0 704 749. As has been set forth in EP-A 0 528 476 a method of preparing a silver halide light-sensitive photographic material incorporating layers of silver halide precipitated in colloidal silica serving as a protective colloid is given. In this document the silver halides are prepared in colloidal silica, leading to emulsion crystals that are stable at the end of the precipitation, without however having a predictable mean crystal diameter and crystal size distribution. These problems have been overcome as has been described in EP-A 0 682 287, for the preparation of crystals rich in silver chloride, wherein clearly defined circumstances wherein such crystals can be prepared: during the precipitation stage of regular silver chloroiodide crystals amounts of silica sol and of stabilising onium compound(s), should be optimised in order to avoid uncontrolled formation and growth of aggregates.

After precipitation the emulsions can be coagulated and washed in order to remove the excess soluble salts. These procedures are together with different alternative methods like dia- or ultrafiltration and ion-exchange described in Res.Discl., 2538957 (1996), section III. The silver halide emulsions of this invention which are prepared in one of the ways described hereinbefore contain crystals which have a spherical equivalent diameter (SED) of not more than 1.5 mm but preferable less than 1.0 mm. The spherical equivalent diameter (SED) of the crystal represents the diameter of the sphere which has the same volume as the average volume of the silver halide crystals of the said emulsion.

The emulsions can be surface-sensitive emulsions which form latent images primarily on the surface of the silver halide grains or they can be emulsions forming their latent-image primarily in the interior of the silver halide grain. Further the emulsions can be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

The photographic elements comprising the said silver halide emulsions can include various compounds which should play a certain role in the material itself or afterwards in the processing, finishing or warehousing the photographic material.

These products can be stabilizers and anti-foggants. The antifoggant prevents occurance of a fog while a stabilizer has a function of stabilizing the photographic property. The antifoggant and the stabilizer are used in preparation, storage or processing stage of the photographic material. The anti-foging agent and the stabilizers can be azoles, mercaptopyrimidines, mercaptotriazines, azaindenes, etc. (see Res.Discl., 38957 (1996) section VII).

The hydrophilic colloidal layer (silver halide emulsion layer, backing layer, antihalo-layer, etc.) of the photographic material can contain an inorganic or an organic hardening agent (see Res.Discl.,38957 (1996) section IIB), brighteners (see Res.Discl.,38957 (1996) section VI), light absorbers and scattering materials (see Res.Discl.,38957 (1996) section VIII), coating aids (see Res.Discl.,38957 (1996) section IXA), antistatic agents (see Res.Discl.,38957 (1996) section IXC), matting agents (see Res.Discl.,38957 (1996) section IXD) and development modifiers (see Res.Discl.,38957 (1996) section XVIII).

The photographic element may further comprise various other additives such as e.g. compounds improving the dimensional stability of the photographic element, ultraviolet absorbers and spacing agents. Suitable additives for improving the dimensional stability of the photographic element are e.g. dispersions of a water-soluble or hardly soluble synthetic polymer e.g. polymers of alkyl (meth) a-crylates, alkoxy (meth) acrylates, glycidyl (meth) acrylates, (meth)acrylamides, vinyl esters, acrylonitriles, olefins, and styrenes, or copolymers of the above with acrylic acids, methacrylic acids, a-b-unsaturated dicarboxylic acids, hydroxyalkyl (meth)acrylates, sulphoalkyl (meth) acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 56-2784, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in Res.Discl.,38957 (September 1996) Section VI, wherein also suitable optical brighteners are mentioned.

Spacing agents may be present of which, in general, the average particle size is comprised between 0.2 and 10 mm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Prior to coating any thickening agent may be used in order to regulate the viscosity of the coating solution, provided that they do not particularly affect the photographic characteristics of the silver halide emulsion in the coated photographic material. Preferred thickening agents include aqueous polymers such as polystyrene sulphonic acid, dextran, sulphuric acid esters, polysaccharides, polymers having a sulphonic acid group, a carboxylic acid group or a phosphoric acid group as well as colloidal silica. Polymeric thickeners well-known from the literature resulting in thickening of the coating solution may even be used in combination with colloidal silica. Patents concerning thickening agents are e.g. U.S. Pat. No. 3,167,410; Belgian Patent No. 558.143 and JP-A's 53-18687 and 58-36768. Negative effects on physical stability possibly resulting from the addition of polymeric compounds can be avoided by exclusion of those compounds and by restricting extra additions of colloidal silica.

In order to reach a high hardening degree the layer binder should of course dispose of an acceptably high number of functional groups, which by reaction with an appropriate hardening agent can provide a sufficiently resistant layer. Such functional groups are especially the amino groups, but also carboxylic groups, hydroxy groups, and active methylene groups. Hardeners may be added to the antistress layer, covering one or more light-sensitive silver halide emulsion layers rich in chloride before or during the coating procedure, or to one or more of the said emulsion layers. The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexa-hydro-s-triazine, active halogen compounds e.g. 2,4-dichloro-6-hydroxy-s-triazine, and mucohalogenic acids e.g. mucochloric acid and mucophenoxy-chloric acid. These hardeners can be used alone or in combination. The binders can also be hardened with fast-reacting hardeners such as carbamoylpyridinium salts. Formaldehyde and phloroglucinol can e.g. be added respectively to the protective layer(s) and to the emulsion layer(s). Further suitable possibilities for hardening can be found in Res.Discl.,38957 (September 1996) section IIB.

The photographic elements can be coated on a variety of supports which can be flexible or rigid. The flexible materials include plastic films and papers while the rigid materials include glass, metals, etc. The surface of the support is generally subjected to undercoating treatment (like corona discharge, irradiation with ultraviolet rays, etc) to enhance the adhesion with the silver halide emulsion layer (see Res.Discl.,38957 (1996) section XV and the references cited therein). The photographic elements can be exposed to actinic radiation, specially in the visible, near-ultraviolet and near-infrared region of the spectrum, to form a latent image (see Res.Discl., 38957 (1996) section XVI). This latent-image can be processed in order to form a visible image (see Res.Discl.,38957 (1996) section XIX).

Various exposure means can be employed for exposure of the photographic material of the invention. As the light source, any optional light source releasing a radiation corresponding to the sensitivity wavelength of the photographic material can be employed. Examples of the light sources generally used include natural light, incandescent lamp, halogen lamp, mercurey lamp, fluorescent lamp and all types of flash light sources. Light sources that emit light in the ultraviolet to infrared region can be also used as recording light sources. Photographic materials can for example also be exposed to gas lasers, semiconductor lasers, light emitting diodes or plasma light sources. In the same way the material can be exposed to a LCD light source or to a fluorescent surface given by a phosphor stimulated with electron rays. This latent-image formed in the silver halide crystals after exposure can be processed in order to form a visible image. Therefore various methods are known and many developing, fixing and stabilizing agents are described for the formation of photographic silver image. These know-how for processing photographic silver halide materials which principally can be used in relation with the present invention is described in Res.Discl.,176043 (December 1978) sections XIX to XXIV and in Res.Discl.,38957 (1996) section XIX).

In the conventional way of processing most of the materials are developed by means of a liquid containing hydroquinone as main developing agent usially in combination with a so-called auxiliarydeveloper. In a alternative way of processing hydroquinone is incorporated in the photographic material itself while the processing liquid is an mere alkaline solution. However it is important to realize that hydroquinone is suspect in various ways specially in an ecological and medical point of view. The present invention is also related with a more ecological way of processing where hydroquinone is at least partly replaced by ascorbic acid as developing agent. Ascorbic acid should be interpreted in a broad sense and includes ascorbic acid isomers, derivatives, salts and analogous compounds (including some reductones and reductic acid derivatives). The most preferred compounds are ascorbic acid, iso-ascorbic acid and their salts. Useful combinations of developers containing an ascorbic acid developing agent which should be preferably used in the scope of the present invention is described for many applications (in graphics, radiography, etc) in Res.Discl., 37152 (March 1995) 185–224.

The photographic emulsions according of the present invention can also be used in multi-layered multicolor materials. These materials comprise a support and two or more silver halide emulsion layers that have different spectral sensitivities. The multi-layered color photographic material generally comprises at least one red-sensitive emulsion layer, at least one green-sensitive emulsion layer and at least one blue-sensitive emulsion layer on a support. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer in order to enhance the sensitivity.

The silver halide material can also contain different types of couplers which can be incorporated in color photographic materials. The red-sensitive emulsion layer contains generally a cyan coupler, the green-sensitive layer generally contains a magenta coupler and the blue-sensitive emulsion layer generally contains a yellow coupler. All the information which can be important for the application of the present invention in these type of materials is extensively described in Res.Discl.,38957 (September 1996) section X. More information in relation with the various color applications which belong also to the scope of the present invention, can be found in U.S. Pat. No. 5,532,120 too.

Processing to form a visible dye image for colour materials means contacting the element with a colour developing agent in order to reduce developable silver halide and to oxidize the colour developing agent which in turn normally reacts with a coupler to form a dye (see Res. Discl.,38957 (1996)section XX).

The invention is described hereinafter by way of the following examples.

EXAMPLES

Example 1

The example described hereinafter will clearly demonstrate the practical advantages which can be realised with a chemical chalcogenic sensitizer of the present invention compared with a conventional sulphur-gold chemical sensitization and compared with a chemical selenium sensitization usually utilized for getting high sensitive silver halide emulsions.

For this experiment the following three solutions were prepared for use during the precipitation:

- solution (1): containing 500 grams of silver nitrate in 1500 ml demineralized water;
- solution (2): containing 129.45 grams of potassium bromide in 555 ml demineralized water;
- solution (3): containing 213.41 grams of potassium bromide and 4.88 grams of potassium iodide in 930 ml demineralized water.

These solutions were kept at 55° C. before and during precipitation.

Preparation of Emulsion 1.

(a) Nucleation step:

The solutions (1) and (2) were introduced into a reaction vessel during 35 seconds at 26 ml per minute using the double jet technique. Said reaction vessel initially contained 2127 ml of distilled water at 51° C., 12.5 grams of potassium bromide and 6 grams of gelatin. After one minute the reaction temperature of this mixture was raised to 70° C. in 20 minutes and a solution of 47.5 grams of phtalated gelatin in 475 ml of distilled water were added. After 6 minutes the neutralisation step was started.

(b) Neutralisation step:

Solution (1) was added to the reaction vessel at a rate of 7.5 ml per minute to reach a pAg value of 8.99 (−10 mV versus a saturated Ag/AgCl reference electrode), whereafter the first growth step was started.

(c) First growth step:

A double jet precipitation was started using solutions (1) and (2) which continued for 45 minutes 44 seconds. The flow rate of solution (1) was 7.5 ml per minute at the start, linearly increasing to 14.5 ml per minute at the end of the precipitation. During this precipitation, the pAg value was kept constant at 8.99. Thereafter the second neutralisation step was started.

(d) Second neutralisation step:

Solution (1) was added to the reaction vessel at a rate of 7.5 ml per minute in order to reach a pAg value of 7.38, whereafter the precipitation further continued with a second growth step.

(e) Second growth step:

904 ml of solution (1) was injected into the reaction vessel at a rate of 7.5 ml per minute at the start, linearly increasing to 22.5 ml per minute at the end of the precipitation. The pAg was kept constant at 7.38 using solution (3) for 60 minutes and 15 seconds.

The emulsion was flocculated after addition of a small amount of polystyrene sulphonic acid and the acidification to a pH value of 3.4. After sedimentation the mother liquid was removed, distilled water added and remaining salts were washed out after repeating this procedure.

The AgBrI-emulsion prepared in this way contained crystals which have a mean spherical diameter of 0.964 mm and a thickness of 0,22 mm.

The chemical sensitization step.

After redispersing the emulsion with demineralized water (till 120 grams of silver nitrate per 1000 grams of the emulsion) various compounds were added as described hereinafter. The emulsion is therefor first adjusted at a pH value of 5.5 and a pAg value of 8.08 (measured at 40° C.) followed by the successive addition (measured per 500 grams of silver nitrate) of:

TABLE 1.1

Conditions for the chemical sensitization for the given tabular AgBrI-emulsion.

| Exp. Nr. | Hypo ($10^{-5}$ mole/mole Ag) | Au-cpd ($10^{-6}$ mole/mole Ag) | Used Se-lenium-cpd. | Se-cpd ($10^{-6}$ mole mole Ag) | |
|---|---|---|---|---|---|
| 1.1 | 1.085 | 1.72 | — | — | comparison |
| 1.2 | 0.543 | 3.20 | Ref-2 | 2.97 | comparison |
| 1.3 | 1.086 | 6.40 | Ref-2 | 5.94 | comparison |
| 1.4 | 0.543 | 3.20 | S-I | 2.97 | invention |
| 1.5 | 1.086 | 6.40 | S-I | 5.94 | invention |

- 5 ml of a polyoxyalkylene compound, immediately followed by
- 4 ml of a 1.03 molar solution of potassium thiocyanate, after 5 minutes followed by
- 0.2 ml of a 0.00476 molar solution of sodium thiosulphonic acid, after 5 minutes by
- 780 ml of a solution of hydro-5,5'-dichloro-3,3'-bis-(n.sulfobutyl)-9-ethyloxacarbo-cyanine hydroxide (2.5 gram per liter) as a green sensitiser and after 30 minutes
- a solution of sodiumthiosulphate (called "hypo"), a solution of auric chloride (called "Au-cpd") and a solution of a selenium compound (called "Se-cpd") in amounts as indicated in Table 1.1.

After raising the temperature till 60° C. the emulsions are chemically sensitized for 3 hours. Triphenylselenofosfine (Ref-2) is used as reference selenium-compound:

Ref-2

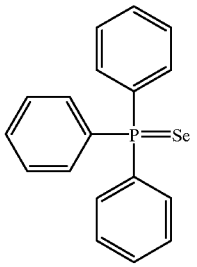

Coating of the Emulsions 1.1–1.5

After the chemical ripening periode the temperature is lowered till 38° C. while the pH is adjusted at 6.1 and the pAg at 8.87, immediately followed by the subsequent addition of an amount triazaindolizine sufficient to stabilize the emulsions and several wetting agents in order to coat the emulsions on a polyethylene terephthalate support. Gelatine is added till the ratio of gelatine over silver nitrate is 1.0. The resulting photographic material contained about 2.3 grams of $AgNO_3$ per $m^2$ as indicated in Table 1.2. The hardening was realised by the addition of a bis-vinylsulfonmethane compound.

Illumination and processing procedure.

The samples of these coating were exposed during $10^{-2}$ sec through a stepwedge (cnst=0.15) in a EDGERTON 'EG & G'-Sensitometer with green light by using an U535-filter. The processing was carried out at 33° C. in a total processing-time of 90 sec by using G138 as developer and a diluted G334 (addition of 4 parts of demineralized water to 1 part G334) as fixer. Both developer and fixer are commercial products which are trademarket names of Agfa-Gevaert.

The density which was realised after processing as a function of the light dose was measured and used to determine the following parameters:

Exp Nr. corresponds with the Exp Nr. of Table 1.1 and the data summarized behind it;

ABS gives the absolute value of a sensitometric parameter for a given experiment number which is indicated by the corresponding heading; REL gives the relative value of the sensitometric parameter indicated in the heading of the column, measured in relation with the data for experiment number 1.1;

TABLE 1.2

Sensitometric results of the emulsions after chemical sensitization under different ripening conditions.

| Exp Nr | ABS REL | $AgNO_3$ ($g/m^2$) | $D_{min}$ | $D_{max}$ | Sens (0.1 > fog) | Sens (0.2 > fog) | |
|---|---|---|---|---|---|---|---|
| 1.1 | ABS | 2.30 | .176 | 1.15 | 0.90 | 1.07 | comparison |
| | REL | — | — | — | 0.00 | 0.00 | |
| 1.2 | ABS | 2.38 | .113 | 1.21 | | | comparison |
| | REL | — | — | — | +0.19 | +0.17 | |
| 1.3 | ABS | 2.30 | .188 | 1.02 | | | comparison |
| | REL | — | — | — | +0.05 | +0.02 | |
| 1.4 | ABS | 2.30 | .096 | 1.12 | | | invention |
| | REL | — | — | — | +0.08 | +0.07 | |
| 1.5 | ABS | 2.30 | .192 | 1.19 | | | invention |
| | REL | — | — | — | +0.14 | +0.07 | |

Dmin is the fog level (expressed with an accuracy of 0.001);

Dmax is the maximum density (expressed with an accuracy of 0.01);

Sens (0.1>fog) means the sensitivity in log(it)-units which is realised at a density of 0.1 above fog level;

Sens (0.2>fog) means the sensitivity in log(it)-units which is realised at a density of 0.2 above fog level.

The results of this example (as summarized in Table 1.2) clearly demonstrates that the use of a compound according to formula (1) of this invention and represented by selenobenzthiazol with neighbouring group participation gives a significant increase in sensitivity-fog-relation. This is shown by comparison with the results realised in the materials having an emulsion which is only sulphur/gold-sensitized (Exp Nr. 1.4-1.5 against 1.1). Comparising these results (Exp Nr. 1.4–1.5) with the results realised with the materials containing a silver halide emulsion sensitized with a selenium compound which is normally used to get a high sensitive photographic material (Exp Nr. 1.2–1.3), it is also shown that the compounds of this invention can give at least the same high sensitivity-fog levels.

Example 2

This example demonstrates the possibilities of a silver halide emulsion comprising tabular AgBrI-crystals which have been chemically sensitized with a chalcogenic chemical sensitizer of the present invention compared with a chemical sensitizer which lack the neighbouring group participating action. It also illustrates the influence of other chemical sensitizers like sulphur and goldsalts.

For this example three solutions were used during the precipitation of emulsion (2):

Solution 1: 1.5 liter of an aqueous solution containing 500 grams of silver nitrate.

Solution 2: 1.5 liter of an aqueous solution containing 350 grams of potassium bromide.

Solution 3: 1.5 liter of an aqueous solution containing 341 grams of potassium bromide and 7.5 grams of potassium iodide.

Preparation of Emulsion 2.

(a) Nucleation step:

15.2 ml of solutions 1 and 2 were introduced into a reaction vessel in 35 seconds using the double jet technique. Said reaction vessel initially contained 2127 ml of distilled water at 51° C., 12.5 grams of potassium bromide and 6 grams of gelatin. After one minute the reaction temperature of this mixture was raised to 70° C. in 20 minutes and a solution of 47.5 grams of phtalated gelatin in 475 ml of distilled water were added. After 6 minutes the neutralisation step was started.

(b) Neutralisation step:

Solution 1 was added to the reaction vessel at a rate of 7.5 ml per minute to reach a pAg value of 8.99 (−10 mV measured against a saturated Ag/AgCl reference electrode), whereafter the first growth step was started.

(c) First growth step:

A double jet precipitation was started using solutions 1 and 2 which continued for 45 minutes 44 seconds. During this precipitation, the pAg value was kept constant at 8.99. The flow rate of solution 1 was 7.5 ml per minute at the start, linearly increasing to 14.5 ml per minute at the end of the precipitation. Thereafter the second neutralisation step was started.

(d) Second neutralisation step:

Solution 1 was added to the reaction vessel at a rate of 7.5 ml per minute in order to reach a pAg value of 7.38, whereafter the precipitation further continued with a second growth step.

(e) Second growth step:

An amount of 0,904 l of solution 1 was injected into the reaction vessel at a rate of 7.5 ml per minute at the start, linearly increasing to 22.5 ml per minute at the end of the precipitation. The pAg was kept constant at 7.38 using solution 3 for 60 minutes and 15 seconds.

The emulsion was flocculated after addition of a small amount of polystyrene sulphonic acid and the acidification to a pH value of 3.4. After sedimentation the mother liquid was removed, distilled water added and remaining salts were washed out after repeating this procedure. The AgBrI crystals of the emulsion prepaired in this way were containing 1 mol % of iodide and had a spherical equivalent diameter (SED) of 0.93 mm while the thickness was 0.22 mm.

Chemical sensitization of Emulsion 2.

The emulsion was redispersed and after addition of various compounds as described hereinafter chemically ripened to an optimal fog-sensitivity relationship. After positioning the emulsion at pH value of 5.5 and at the pAg value of 8.08 (at a temperature of 40° C.) the following solutions were added successively (per 500 gram of AgNO3):

4 ml of a 1.03 molar solution of potassium thiocyanate, after 10 minutes followed by 0.2 ml of a 0.00476 molar solution of sodium thiosulphonic acid, after 5 minutes by 780 ml of a solution of hydro-5,5'-dichloro-3,3'-bis-(n.sulfobutyl)-9-ethyloxacarbo-cyanine hydroxide (2.5 gram per liter) as a green sensitiser and after 30 minutes a solution of (0.00632 mole/l) sodiumthiosulphate (called "S-cpd"), a solution of (0.001456 mole/l) auric chloride ("Au-cpd) and a solution of a selenium compound ("Se-cpd").

TABLE 2.1

Chemical sensitization conditions for the tabular AgBrI-emulsion.

| Exp Nr. | "Se-cpd" | "S-Cpd" (ml) | "Au-Cpd" (ml) | |
|---|---|---|---|---|
| 2.1 | S-I | 2.5 | 6.5 | Invention |
| 2.2 | S-VI | 2.5 | 6.5 | Invention |
| 2.3 | Ref-1 | 2.5 | 6.5 | Comparison |
| 2.4 | S-I | 2.5 | 10 | Invention |
| 2.5 | S-VI | 2.5 | 10 | Invention |
| 2.6 | Ref-1 | 2.5 | 10 | Comparison |
| 2.7 | S-I | 2.5 | 15 | Invention |
| 2.8 | S-VI | 2.5 | 15 | Invention |
| 2.9 | Ref-1 | 2.5 | 15 | Comparison |

In this particular case several selenobenzthiazoles were used as chalcogenic compound which were added in an amount of 3 ml of an 0,0035 N solution per 500 grams of silver halide. The chemical sensitizion of all the sample emulsions were carried out at 60° C. in the presence of a sulphur and a gold compound (see respectively "S-cpd" and "Au-cpd" in the table) in amounts (number of ml of the named solutions) as indicated in Table 2.1 (always per 500 grams of silver halide).

Coating of Emulsion 2.

After chemical sensitization each emulsion was stabilized with 10 ml of 0.00375 mole/l 4-hydroxy-6-methyl-1,3,3a, 7-tetra-azaindene and after addition of the normal coating additives the solutions were coated simultaneously together with a protective layer containing 0.7 g of gelatine per m2 per side on both sides of a polyethylene terephthalate film support having a thickness of 175 mm. The resulting photographic material contained per side an amount of silver halide corresponding to 3.90 grams of AgNO3 per m2. Hardening of the layers was performed with a bis-vinylsulfonmethane compound.

Exposure and processing procedure.

Samples of these coatings were exposed with green light of 540 nm during 0.1 seconds using a continuous wedge and were processed during the 90 seconds cycle described below. The processing occurred in a glutaraldehyde containing hydroquinone/1-phenyl-3-pyrazolidinone developer marketed by Agfa-Gevaert N.V. under the trade name G138. Fixation was carried out in fixer G334, also marketed by Agfa-Gevaert N.V. The processing was executed in a HT-300 processing machine (marketed by Agfa-Gevaert as well) with the following time (in seconds (sec.)) and temperature (in ° C.) characteristics:

loading: 3.4 sec.

developing: 23.4 sec./33° C. high or low activity developer cross-over: 3.8 sec.

fixing: 15.7 sec./33° C. in fixer AGFA G334 cross-over: 3.8 sec.

rinsing: 15.7 sec./20° C.

drying: 32.2 sec. (cross-over time included)

total time: 98.0 sec.

The results of the various experiments are summarized in Table 2.2 where the experiment number Exp Nr. corresponds with the same number in Table 2.1. The density which was realised after processing as a function of the light dose was measured and used to determine the following parameters:

TABLE 2.2

Sensitometric results of the emulsions after chemical sensitization under different ripening conditions.

| Exp Nr. | Se-compd | Fog $10^{-3}$ | Sensitivity S | g | |
|---|---|---|---|---|---|
| 2.1 | S-I | 19 | 1.76 | 1.74 | Invention |
| 2.2 | S-VI | 14 | 1.94 | 1.96 | Invention |
| 2.3 | Ref-1 | 11 | 2.02 | 2.03 | Comparison |
| 2.4 | S-I | 22 | 1.59 | 2.30 | Invention |
| 2.5 | s-vI | 18 | 1.88 | 2.13 | Invention |
| 2.6 | Ref-1 | 14 | 1.97 | 1.97 | Comparison |
| 2.7 | S-I | 24 | 1.66 | 2.34 | Invention |
| 2.8 | S-VI | 17 | 2.04 | 1.95 | Invention |
| 2.9 | Ref-1 | 16 | 2.09 | 1.99 | Comparison |

Fog level (with an accuracy of 0.001 density), the sensitivity S is given at a density of 1 above fog expressed in log(It): a decrease with a factor of 0.30 is indicative for a sensitivity increase with a factor of 2, the contrast g was calculated between densities 1.0 and above fog.

From these results it can be clearly seen that the chemical sensitization of the tabular AgBrI-emulsion with the chalcogenic compounds of this invention results in a substantial increase in sensitivity compared with the compounds which lacks neighbouring group participation. This effect can be optimized if the chemical sensitization is carried out under controlled conditions of the amount of sulfur and gold sensitizer.

Example 3

Preparation of emulsion 3.

For the preparation of the emulsion used in this example the following three solutions were used:

Solution 1: 1.5 liter of an aqueous solution containing 500 grams of silver nitrate.

Solution 2: 1.5 liter of an aqueous solution containing 349.9 grams of potassium bromide.

Solution 3: 1.5 liter of an aqueous solution containing 344.2 grams of potassium bromide and 7.87 grams of potassium iodide.

The preparation steps were a nucleation and a first neutralization step, followed by a first growth step, a second neutralization step and a second growth step.

(a) Nucleation step.

15.2 ml of solutions 1 and 2 were introduced into a reaction vessel in 35 seconds using the double jet technique. Said reaction vessel initially contained 2.16 liter of distilled water at 51° C., 12.59 grams of potassium bromide and 6 grams of a low isoelectric point gelatin. After 25 seconds the reaction temperature of the mixture was raised to 70° C. in 26 minutes including the addition of 47.5 grams of phthalated gelatin in 475 ml destined water during the last 6 minutes.

(b) Neutralization step

Then solution 1 was added to the reaction vessel at a rate of 7.5 ml per minute to reach a pAg of 9.1, whereafter the first growth step was started.

(c) First growth step.

A double jet precipitation was started using solutions 1 and 2 which continued for 46 minutes 44 seconds. During this precipitation, the pAg value was kept constant at 9.1. The flowing rate of solution 1 was 7.5 ml per minute at the start, linearly increasing to 14.5 ml per minute at the end of the precipitation. In the same time solution 2 was introduced at 7.8 ml per minute at the start linearly increasing till 15.0 ml per minute at the end keeping the pBr value at the same constant level. Further the second neutralisation phase was started.

(d) Second neutralization step.

63.75 ml of solution 1 was added at a rate of 7.5 ml per minute so that a pAg of 7.5 was obtained. The precipitation was then continued by a second growth step.

(e) Second growth step.

Solutions 1 and 3 were injected during 61 minutes and 15 seconds in the reaction vessel at a rate of 7.5 ml per minute at the start linearly increasing to 22.5 ml per minute at the end of the precipitation. The pAg was kept constant at 7.5.

Washing and dispersing procedure for Emulsion 3.

At the end of the precitation the pH value was lowered to 3.5 with diluted sulphuric acid which was followed by the addition of 3.0 ml of a 14% by weight solution of polystyrenesulphonic acid sodium salt and by a washing procedure using demineralized water of 11° C. Then another 116.5 grams of the same LIP-gelatine as used in the nucleation step was added to the solution which was further digerated at 45° C. during 60 minutes.

After precipitation and washing the emulsion was analysed using shadowed carbon replicas obtained with an electron microscope. A minimum of hundred grains were measured and the following characteristics were then calculated:

- the number of tabular grains were calculated, a tabular grain being defined as a grain with two parallel main planes and a ratio between the diameter and the thickness of the grains of at least 2, with
- the diameter being the diameter of a circle having an equivalent projective surface area of the grain and
- the thickness being the distance between the main planes of the flat tabular crystals A characterization of the crystal population of an emulsion was given by

- average diameter: calculated as the average by number from the diameters of the tabular grains.
- coefficient of variation of the tabular grains: calculated as the ratio between the standard deviation of the average diameter and the average diameter
- average thickness: calculated as the average by number from the distance between the main planes measured for all crystals
- aspect ratio: as the ratio between the mean calculated diameter and the mean calculated thickness defined hereinbefore
- percentage of the total projective surface: part of the total projective area covered by the tabular grains in percentage.

The tabular grain emulsion obtained, had the following characteristics, measured with electron microscopic techniques:

average diameter: 0.74 mm coefficient of variation of the tabular grains: 0.28 average thickness: 0.22 mm aspect-ratio: 6.1 percentage of total projective surface: >90%.

The chemical sensitization of Emulsion 3.

After redispersing the emulsion with demineralized water various compounds were added as described hereinafter. The emulsion is therefore first adjusted at a pH value of 6.0 and a pAg value of 7.5 (measured at 40° C.) followed by the successive addition (measured per 500 grams of silver nitrate) of:

- 0.8 ml of a 0.00476 molar solution of sodium thiosulphonic acid in demineralized water, after 5 minutes followed by
- 150 ml of a 1.256*10−2 molar solution of the following blue spectral sensitizer:

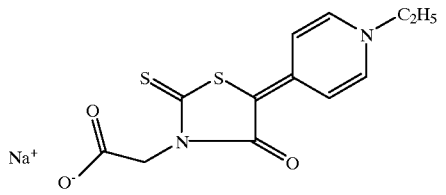

after 30 minutes followed by

- 2.5 ml of a 1.03 molar solution of potassium thiocyanate, after 5 minutes followed by the consecutive addition of
- a solution of a selenium sensitizer representative for this invention (in concentrations as indicated in Table 3) but also by a solution of Se-sensitizer Ref-2 as reference (see the formula given in example 1),
- 3.4 ml of a (0.00632 mole/l) sodiumthiosulphate solution and 6.5 ml of a (0.001456 mole/l) auric chloride solution.

The chemical ripening of several samples were carried out at 54° C. by using concentrations of chemical ripening agents as indicated in Table 3.

After ripening the sensitized emulsions were stabilized with 10.0 ml of a 3.75*10−3 molar solution of the following stabilizer:

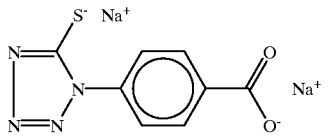

and cooled till 38° C., followed by the addition of 3 ml of a concentrated fenol solution.

Coating of Emulsion 3.

The coating was carried out on polyethylene terephthalate film support having a thickness of 175 mm, after the addition of a normal coating additive at a layer thichness where the amount of silver halide per square meter, expressed as the equivalent amount of AgNO3 (in g/m2), is 6.0.

Exposure, sensitometric and densitometric data.

Samples of these coatings were exposed to visible light through a continuously varying carbon-coated wedge(wedge constant 0.15), a densitometric filter with a density of 1.2. The exposed samples were processed as described below. The density as a function of the light dose was measured which results were used for the determination of the following parameters:

- fog level (in 0.001 density-units);
- the sensitivity S at a density of 1 above fog (a decrease of 0.3 log(It) means an increase in sensitivity with a factor 2).

Processing conditions.

The processing occurred in a glutaraldehyde containing hydroquinone/1-phenyl-3 -pyrazolidinone developer marketed by Agfa-Gevaert N.V. under the trade name G138 having a high activity. The development step was stopped by using a strong acid bath G 351 (Agfa-Gevaert trade name). The fixation was realised by using G334-fixer (Agfa-Gevaert trade name) with was followed by washing and a drying step with the characteristics as summarized below:

developing: 120 seconds at 25° C. in AGFA G138-developer, stopbath: 35 seconds at 25° C. in AGFA G351, fixing: 90 second s at 25° C. in fixer AGFA G334, rinsing: 40 seconds at 25° C. in demineralized water.

The results summarized in Table 3 show clearly the activity of the selenium compounds of this invention for use in blue sensitized tabular AgBrI emulsions. It can be noticed that compound S-I which satisfies formula (1) and in particular formula (3) improves the sensitivity in a significant way (Exp.Nr. 3.3 and 3.4 versus Exp.Nr. 3.1). Comparing the activity of thee selenium sensitizer S-I with the activity of the reference Se-sensitizer Ref-2, one can also see that the fog level decreases in the case comparable amounts of Se-sensitizer are used.

TABLE 3

Sensitometric results in function of the selenium compounds used during the chemical Au/S-sensitization.

| Exp. Nr. | Se-cpd | Se-conc. μmole | Fog $*10^{-3}$ | Sensitivity S (log it) |
|---|---|---|---|---|
| 3.1 | — | — | 8 | 2.83 |
| 3.2 | Ref-2 | 3.52 | 31 | 2.56 |
| 3.3 | S-I | 3.64 | 21 | 2.57 |
| 3.4 | S-I | 7.29 | 54 | 2.63 |

Having described in detail preferred embodiments of the current invention, it will now be apparent to those skilled in the art that numerous modifications can be made therein without departing from the scope of the invention as defined in the following claims.

What is claimed is:

1. A photosensitive element comprising on a support, at least one silver halide emulsion layer and a non-light sensitive hydrophilic colloid layer wherein the silver halide emulsion layer comprises a chalcogenic compound represented by formula (1):

(1)

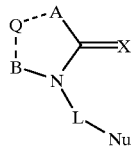

wherein:

X represents Se or Te, forming a double bond with its neighboring C-atom,

Nu represents a nucleophilic acidic group forming a heterolytic bond with its free electron pair, L represents a divalent linking group, AQB represents the necessary atoms to form a heterocyclic 5- or 6-membered ring, provided that when A is a Nitrogen-atom, B is an atom selected from the group consisting of $NR^1$, O, S, Se and Te, $R^1$ can represent a hydrogen atom, an alkyl group, an acyl group, an aryl group, an aralkyl group or a heteroaryl group.

2. A photosensitive element according to claim 1, wherein the nucleophilic group Nu has a $pK_a$-value of 2.0 or more.

3. A photosensitive element according to claim 1, wherein said compound is a chalcogenic compound satisfying formula (2):

(2)

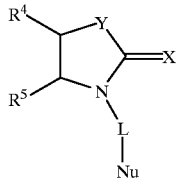

wherein:

X represents Se or Te, forming a double bond with its neighboring C-atom,

Nu represents a nucleophilic acidic group forming a heterolytic bond with its free electron pair, L represents a divalent linking group, Y represents S, O, $CR^2R^3$, Se or Te, $R^2$ and $R^3$ each independently represents a hydrogen atom, an alkyl group, an aryl group, an aralkyl group or a heteroaryl group, or $R^2$ and $R^3$ each independently represents the atoms which together with $R^4$ or $R^5$ are necessary to form a ring structure, or $R^2$ and $R^3$ each independently represents a hydrogen atom, an alkyl group, an aryl group, an aralkyl group or a heteroaryl group which combine to form a ring structure, $R^4$ and $R^5$ each independently represents a hydrogen atom, an alkyl group, an aryl group, an aralkyl group or a heteroaryl group, or $R^4$ and $R^5$ together represent the atoms necessary to form a ring structure.

4. A photosensitive element according to claim 3, wherein the nucleophilic group Nu has a $pK_a$-value of 2.0 or more.

5. A photosensitive element of claim 1, wherein the said compound is a chalcogenic compound satisfying formula (3):

(3)

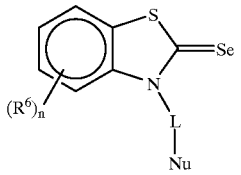

wherein:

Nu represents a nucleophilic acidic group forming a heterolytic bond with its free electron pair, L represents a divalent linking group, $R^6$ represents a hydrogen atom, an alkyl group, an aryl group, an aralkyl group or a heteroaryl group, or one or $R^6$ substituents together represent the atoms necessary to form a ring structure, n equals 0, 1, 2, 3 or 4.

6. A photosensitive element according to claim 5, wherein the nucleophilic group Nu has a $pK_a$-value of 2.0 or more.

7. A photosensitive element according to claim 1, wherein at least one silver halide emulsion is chemically sensitized with a chalcogenic compound satisfying formula (1) in an amount of $10^{-8}$ to $10^{-3}$ mole based on one mole of silver halide.

8. A method for chemically sensitizing a silver halide emulsion characterized by the step of adding a sulphur sensitizer, a gold sensitizer or both a sulphur and a gold sensitizer, together with a chalcogenic compound as defined in claim 1.

9. A method according to claim 8, characterized by the step of adding a silver halide solvent to the chalcogenic compound.

10. A method according to claim 8, characterized by the step of adding a spectral sensitizer to the chalcogenic compound.

11. A method according to claim 8, wherein said step of chemically sensitizing a silver halide emulsion is performed in following conditions: a pAg-value in the range of from 6 to 11, a pH-value in the range of from 3 to 10 and a temperature in the range of 40 up to 95° C.

12. A method according to claim 9, wherein the silver halide solvent is a thiocyanate salt.

13. A method according to claim 9, wherein the silver halide solvent is present in an amount of $10^{-6}$ to $10^{-1}$ mole per mole of silver halide.

14. A method according to claim 10, wherein the spectral sensitizer is a cyanine dye containing a benzoxazole, a benzthiazole or a benzimidazole nucleus.

* * * * *